US012104584B2

(12) United States Patent
Takahashi

(10) Patent No.: US 12,104,584 B2
(45) Date of Patent: Oct. 1, 2024

(54) CRYOPUMP AND REGENERATION METHOD OF CRYOPUMP

(71) Applicant: SUMITOMO HEAVY INDUSTRIES, LTD., Tokyo (JP)

(72) Inventor: Kakeru Takahashi, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 439 days.

(21) Appl. No.: 17/493,418

(22) Filed: Oct. 4, 2021

(65) Prior Publication Data

US 2022/0106949 A1 Apr. 7, 2022

(30) Foreign Application Priority Data

Oct. 5, 2020 (JP) ..... 2020-168195

(51) Int. Cl.

*F04B 37/08* (2006.01)
*F04B 37/14* (2006.01)
*F04B 49/06* (2006.01)
*F04B 49/08* (2006.01)

(52) U.S. Cl.

CPC ..... *F04B 37/085* (2013.01); *F04B 37/14* (2013.01); *F04B 49/06* (2013.01); *F04B 49/08* (2013.01); *F04B 2205/10* (2013.01)

(58) Field of Classification Search

CPC ..... F04B 37/08; F04B 37/085; F04B 37/14; F04B 49/06; F04B 49/065; F04B 49/08; F04B 2205/10

See application file for complete search history.

(56) References Cited

U.S. PATENT DOCUMENTS 5,375,424 A * 12/1994 Bartlett ..... F04B 37/08 62/55.5
5,819,545 A * 10/1998 Eacobacci, Jr. ..... F04B 37/085 62/55.5
5,862,671 A * 1/1999 Lessard ..... F04B 37/085 62/55.5

(Continued)

FOREIGN PATENT DOCUMENTS

JP 6351525 B2 7/2018

*Primary Examiner* — Eric S Ruppert
*Assistant Examiner* — Hans R Weiland
(74) *Attorney, Agent, or Firm* — Michael Best & Friedrich LLP

(57) ABSTRACT

A cryopump includes a cryocooler; a cryopanel cooled by the cryocooler; a cryopump container supporting the cryocooler and accommodating the cryopanel; a temperature sensor that measures a temperature of the cryopanel and outputs a measured temperature signal indicating the temperature; a pressure sensor that measures an internal pressure of the cryopump container and outputs a measured pressure signal indicating the internal pressure; a pressure rise rate comparator that compares a pressure rise rate of the cryopump container with a first pressure rise rate threshold; and a cryocooler controller that controls the cryocooler to lower the temperature of the cryopanel. The pressure rise rate comparator compares the pressure rise rate of the cryopump container with a second pressure rise rate threshold. The second pressure region is lower than the first pressure region. The second pressure rise rate threshold is smaller than the first pressure rise rate threshold.

11 Claims, 5 Drawing Sheets

(56) References Cited

U.S. PATENT DOCUMENTS

| | | | | |
|---|---|---|---|---|
| 6,022,195 | A * | 2/2000 | Gaudet | F04D 19/04 417/27 |
| 10,001,117 | B2 | 6/2018 | Oikawa | |
| 10,393,099 | B2 * | 8/2019 | Yatsu | F04B 49/065 |
| 2017/0276129 | A1 * | 9/2017 | Takahashi | F04B 49/06 |

* cited by examiner

CRYOPUMP AND REGENERATION METHOD OF CRYOPUMP

RELATED APPLICATIONS

The content of Japanese Patent Application No. 2020-168195, on the basis of which priority benefits are claimed in an accompanying application data sheet, is in its entirety incorporated herein by reference.

BACKGROUND

Technical Field

Certain embodiments of the present invention relate to a cryopump and a regeneration method of a cryopump.

Description of Related Art

Cryopumps are vacuum pumps that capture gas molecules through condensation and/or adsorption on a cryopanel cooled to a cryogenic temperature and exhaust the gas molecules. The cryopumps are generally used in order to realize a clean vacuum environment required for semiconductor circuit manufacturing processes or the like. Since the cryopumps are so-called gas accumulating type vacuum pumps, regeneration in which the captured gas is periodically exhausted to the outside is required.

SUMMARY

According to an embodiment of the present invention, there is provided a cryopump including a cryocooler; a cryopanel cooled by the cryocooler; a cryopump container that supports the cryocooler and accommodates the cryopanel; a temperature sensor that measures a temperature of the cryopanel and outputs a measured temperature signal indicating the temperature; a pressure sensor that measures an internal pressure of the cryopump container and outputs a measured pressure signal indicating the internal pressure; a pressure rise rate comparator that compares a pressure rise rate of the cryopump container with a first pressure rise rate threshold when the temperature of the cryopanel is in a first temperature zone and the internal pressure of the cryopump container is in a first pressure region, on the basis of the measured temperature signal and the measured pressure signal; and a cryocooler controller that controls the cryocooler so as to lower the temperature of the cryopanel from the first temperature zone to a second temperature zone lower than the first temperature zone in a case where the pressure rise rate of the cryopump container falls below the first pressure rise rate threshold. The pressure rise rate comparator compares the pressure rise rate of the cryopump container with a second pressure rise rate threshold when the temperature of the cryopanel is in the second temperature zone and the internal pressure of the cryopump container is in a second pressure region, on the basis of the measured temperature signal and the measured pressure signal. The second pressure region is lower than the first pressure region, and the second pressure rise rate threshold is smaller than the first pressure rise rate threshold.

According to another embodiment of the present invention, there is provided a regeneration method of a cryopump including measuring a temperature of a cryopanel; measuring an internal pressure of a cryopump container; comparing a pressure rise rate of the cryopump container with a first pressure rise rate threshold when the temperature of the cryopanel is in a first temperature zone and the internal pressure of the cryopump container is in a first pressure region; cooling the cryopanel from the first temperature zone to a second temperature zone lower than the first temperature zone in a case where the pressure rise rate of the cryopump container falls below the first pressure rise rate threshold; and comparing the pressure rise rate of the cryopump container with a second pressure rise rate threshold when the temperature of the cryopanel is in the second temperature zone and the internal pressure of the cryopump container is in a second pressure region. The second pressure region is lower than the first pressure region, and the second pressure rise rate threshold is smaller than the first pressure rise rate threshold.

In addition, any combinations of the above components and those obtained by substituting the components or expressions of the present invention with each other between methods, devices, systems, and the like are also effective as embodiments of the present invention.

DETAILED DESCRIPTION

It is desirable to shorten the regeneration time of the cryopump.

Hereinafter, embodiments for carrying out the present invention will be described in detail with reference to the drawings. In the description and drawings, the same or equivalent components, members, and processing will be designated by the same reference symbols, and redundant description thereof will be appropriately omitted. The scales and shapes of the respective parts illustrated in the figures are set for convenience in order to facilitate the description, and should not be interpreted as limiting unless otherwise specified. The embodiments are merely examples and do not limit the scope of the present invention. All the features and combinations to be described in the embodiments are not necessarily essential to the invention.

Figure 1:
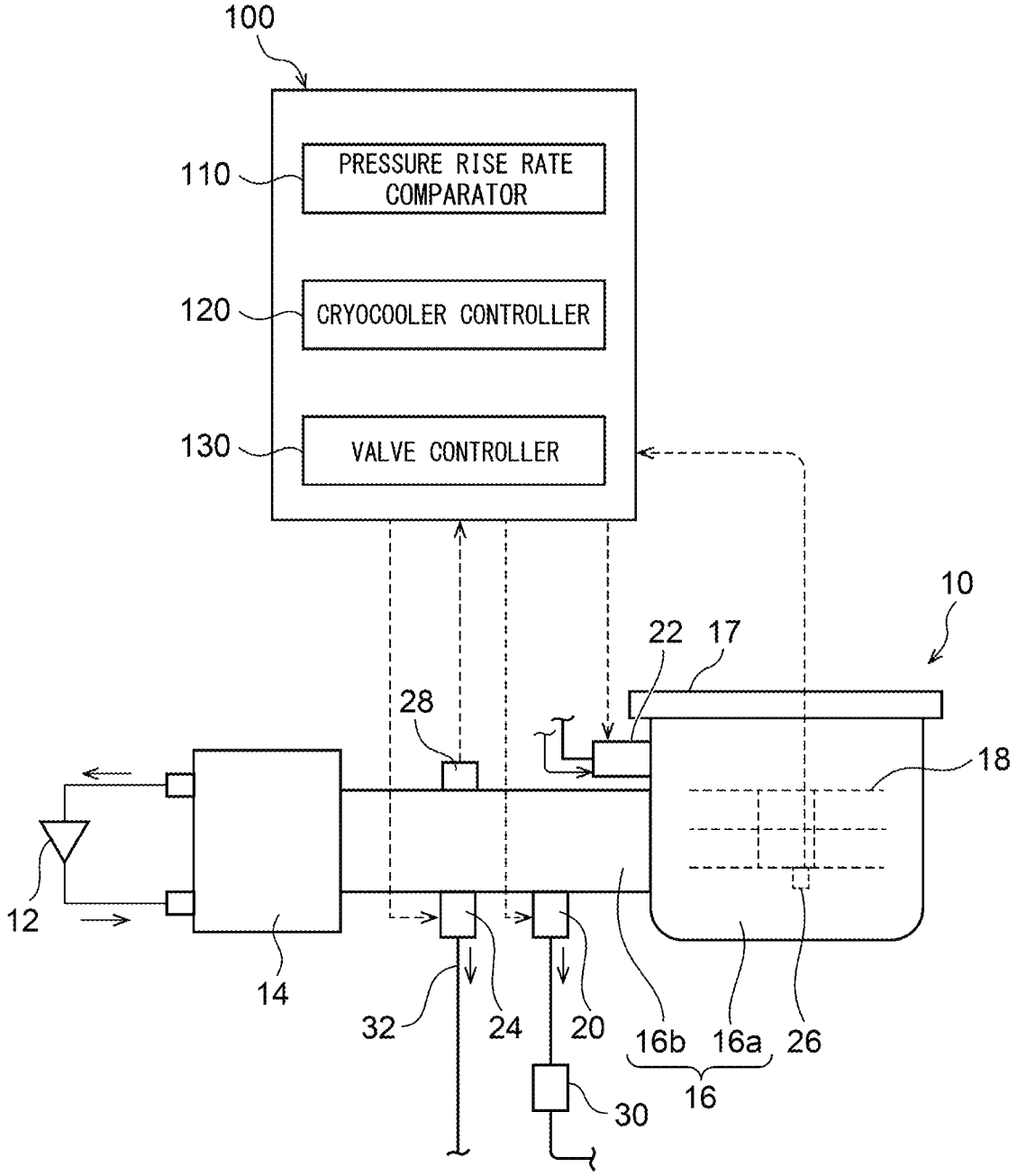
FIG. 1 schematically shows a cryopump according to an embodiment.

FIG. 1 schematically shows a cryopump 10 according to the embodiment. The cryopump 10 is attached to, for example, a vacuum chamber of an ion implanter, a sputtering device, a vapor deposition device, or other vacuum process devices, and is used in order to increase the degree of vacuum inside the vacuum chamber to a level required for a desired vacuum process. For example, a high degree of vacuum of approximately $10^{-5}$ Pa to $10^{-8}$ Pa is realized in the vacuum chamber.

The cryopump 10 includes a compressor 12, a cryocooler 14, a cryopump container 16, a cryopanel 18, and a cryopump controller 100. Additionally, the cryopump 10 includes a rough valve 20, a purge valve 22, and a vent valve 24, which are installed in the cryopump container 16.

The compressor 12 is configured to recover a refrigerant gas from the cryocooler 14, to pressurize the recovered refrigerant gas, and to supply the refrigerant gas to the cryocooler 14 again. The cryocooler 14 is also referred to as an expander or a cold head and constitutes a cryocooler together with the compressor 12. A thermodynamic cycle, through which cooling is generated, is configured by performing the circulation of the refrigerant gas between the compressor 12 and the cryocooler 14 with an appropriate combination of pressure fluctuations and volume fluctuations of the refrigerant gas in the cryocooler 14, and a cooling stage of the cryocooler 14 is cooled to a desired cryogenic temperature. Accordingly, the cryopanel 18 thermally coupled to the cooling stage of the cryocooler 14 can be cooled to a target cooling temperature (for example, 10K to 20K). Although the refrigerant gas is typically a helium gas, other appropriate gases may be used. In order to facilitate understanding, a direction in which the refrigerant gas flows is shown with an arrow in FIG. 1. Although the cryocooler is, for example, a two-stage Gifford-McMahon (GM) cryocooler, the cryocooler may be a pulse tube cryocooler, a Stirling cryocooler, or other types of cryocoolers.

The cryopump container 16 is a vacuum chamber that is designed to maintain vacuum during a vacuum pumping operation of the cryopump 10 and to withstand a pressure in the ambient environment (for example, the atmospheric pressure). The cryopump container 16 has a cryopanel accommodation unit 16*a* having an intake port 17 and a cryocooler accommodation unit 16*b*. The cryopanel accommodation unit 16*a* has a dome shape in which the intake port 17 is opened and the opposite side thereof is closed, and the cryopanel 18 is accommodated inside the cryopanel accommodation unit 16*a* together with the cooling stage of the cryocooler 14. The cryocooler accommodation unit 16*b* has a cylindrical shape, one end thereof is fixed to a room temperature portion of the cryocooler 14, the other end thereof is connected to the cryopanel accommodation unit 16*a*, and the cryocooler 14 is inserted therein. In this way, the cryocooler 14 is supported by the cryopump container 16. The gas entering from the intake port 17 of the cryopump 10 is captured by the cryopanel 18 by condensation or adsorption. Since various known configurations can be appropriately adopted as the configuration of the cryopump 10, such as the disposition and shape of the cryopanel 18, a description thereof will not be made herein in detail.

The rough valve 20 is attached to the cryopump container 16, for example, the cryocooler accommodation unit 16*b*. The rough valve 20 is connected to a rough pump 30 installed outside the cryopump 10. The rough pump 30 is a vacuum pump for evacuating the cryopump 10 to an operation starting pressure. The cryopump container 16 communicates with the rough pump 30 when the rough valve 20 is opened through the control of the cryopump controller 100, and the cryopump container 16 is cut off from the rough pump 30 when the rough valve 20 is closed. By opening the rough valve 20 and operating the rough pump 30, the cryopump 10 can be decompressed.

The purge valve 22 is attached to the cryopump container 16, for example, a cryopanel accommodation unit 16*a*. The purge valve 22 is connected to a purge gas supply device (not shown) installed outside the cryopump 10. Purge gas is supplied to the cryopump container 16 when the purge valve 22 is opened through the control of the cryopump controller 100, and the supply of the purge gas to the cryopump container 16 is cut off when the purge valve 22 is closed. The purge gas may be, for example, a nitrogen gas or other dry gases. The temperature of the purge gas may be adjusted to, for example, the room temperature, or may be heated to a temperature higher than the room temperature. By opening the purge valve 22 to introduce the purge gas into the cryopump container 16, the cryopump 10 can be pressurized. Additionally, the temperature of the cryopump 10 can be raised from the cryogenic temperature to the room temperature or a temperature higher than the room temperature.

The vent valve 24 is attached to the cryopump container 16, for example, the cryocooler accommodation unit 16*b*. The vent valve 24 is provided in order to exhaust a fluid from the inside of the cryopump 10 to the outside thereof. The vent valve 24 is connected to an exhaust line 32 along which the fluid to be exhausted is guided to a storage tank (not shown) outside the cryopump 10. Alternatively, in a case where the fluid to be exhausted is harmless, the vent valve 24 may be configured to release the fluid to be exhausted, to the ambient environment. The fluid to be exhausted from the vent valve 24 is basically a gas, but may be a liquid or a mixture of a gas and a liquid. The vent valve 24 is openable and closable by control and can be mechanically opened by a differential pressure between the inside and the outside of the cryopump container 16. The vent valve 24 is, for example, a normally closed type control valve, and is configured to function as a so-called safety valve.

The cryopump 10 is provided with a temperature sensor 26 that measures the temperature of the cryopanel 18 and outputs a measured temperature signal indicating the measured temperature. The temperature sensor 26 is attached to, for example, the cooling stage of the cryocooler 14 or the cryopanel 18. The cryopump controller 100 is connected to the temperature sensor 26 so as to receive the measured temperature signal.

Additionally, the cryopump 10 is provided with a pressure sensor 28 that measures the internal pressure of the cryopump container 16 and outputs a measured pressure signal indicating the measured internal pressure. The pressure sensor 28 is attached to the cryopump container 16, for example, the cryocooler accommodation unit 16*b*. The cryopump controller 100 is connected to the pressure sensor 28 so as to receive the measured pressure signal.

The cryopump controller 100 is configured to control the cryopump 10. For example, the cryopump controller 100 may control the cryocooler 14 on the basis of the measured temperature of the cryopanel 18 by the temperature sensor 26 in the vacuum pumping operation of the cryopump 10. Additionally, in the regeneration operation of the cryopump 10, the cryopump controller 100 may control the cryocooler 14, the rough valve 20, the purge valve 22, and the vent valve 24 on the basis of the measured pressure in the cryopump container 16 by the pressure sensor 28 (or as necessary, on the basis of the measured pressure in the cryopump container 16 and the measured temperature of the cryopanel 18). The cryopump controller 100 may be provided integrally with the cryopump 10 or may be configured as a control device separate from the cryopump 10.

As shown in FIG. 1, as an exemplary control configuration, the cryopump controller 100 includes a pressure rise rate comparator 110, a cryocooler controller 120, and a valve controller 130.

The pressure rise rate comparator 110 is configured to execute a so-called pressure rise rate test on the basis of the internal pressure of the cryopump container 16 measured by the pressure sensor 28. The pressure rise rate test in the cryopump regeneration is a process of determining that a condensate is sufficiently exhausted from the cryopump 10 in a case where the pressure rise rate in the cryopump container 16 does not exceed a pressure rise rate threshold. The pressure rise rate test is mainly used to check that moisture has been sufficiently exhausted from the cryopump 10. The pressure rise rate in the cryopump container 16 is measured by the pressure sensor 28 in a state where the internal pressure of the cryopump container 16 is isolated from the ambient environment by closing each valve provided in the cryopump container 16. The pressure rise rate test is also referred to as a rate-of-rise (RoR) test.

Existing cryopumps typically perform only a one-step RoR test, and in a case where the test is passed, the cryopump is re-cooled from the room temperature to the cryogenic temperature to complete the regeneration. In contrast, in the cryopump 10 according to the embodiment, the pressure rise rate comparator 110 is configured to execute a two-step RoR test under different temperature and pressure conditions.

As a first RoR test, the pressure rise rate comparator 110 compares the pressure rise rate of the cryopump container 16 with a first pressure rise rate threshold when the temperature of the cryopanel 18 is in a first temperature zone and the internal pressure of the cryopump container 16 is in a first pressure region, on the basis of the measured temperature signal of the temperature sensor 26 and the measured pressure signal of the pressure sensor 28. As a second RoR test, the pressure rise rate comparator 110 compares the pressure rise rate of the cryopump container 16 with a second pressure rise rate threshold when the temperature of the cryopanel 18 is in a second temperature zone and the internal pressure of the cryopump container 16 is in a second pressure region, on the basis of the measured temperature signal of the temperature sensor 26 and the measured pressure signal of the pressure sensor 28. The second temperature zone is lower than the first temperature zone. The second pressure region is lower than the first pressure region, and the second pressure rise rate threshold is smaller than the first pressure rise rate threshold.

In this way, the first RoR test is executed under high temperature and low vacuum, and the second RoR test is executed under low temperature and high vacuum as compared to the first RoR test.

The cryocooler controller 120 is configured to control the cryocooler 14 on the basis of the temperature of the cryopanel 18 measured by the temperature sensor 26 and/or the internal pressure of the cryopump container 16 measured by the pressure sensor 28 during the regeneration of the cryopump 10. For example, the cryocooler controller 120 may control the cryocooler 14 so as to lower the temperature of the cryopanel 18 from the first temperature zone to the second temperature zone lower than the first temperature zone in a case where the first RoR test is passed (that is, in a case where the pressure rise rate of the cryopump container 16 falls below the first pressure rise rate threshold). The cryocooler controller 120 may control the cryocooler 14 so as to lower the temperature of the cryopanel 18 from the second temperature zone to a third temperature zone lower than the second temperature zone in a case where the second RoR test is passed (that is, in a case where the pressure rise rate of the cryopump container 16 falls below the second pressure rise rate threshold).

The valve controller 130 is configured to control the rough valve 20, the purge valve 22, and the vent valve 24 on the basis of the temperature of the cryopanel 18 measured by the temperature sensor 26 and/or the internal pressure of the cryopump container 16 measured by the pressure sensor 28 during the regeneration of the cryopump 10. For example, the valve controller 130 may control the rough valve 20 so that the internal pressure of the cryopump container 16 is maintained in a predetermined pressure region on the basis of the measured pressure signal of the pressure sensor 28 in a state where the temperature of the cryopanel 18 is lowered from the first temperature zone to the second temperature zone.

The cryopump controller 100 may be configured to store various parameters for defining a regeneration sequence of the cryopump 10. The temperature and/or pressure range allowed for each process of the regeneration sequence is defined by such parameters. For example, regarding the RoR test, the parameters include temperature and pressure conditions at which the RoR test is allowed to be executed, the pressure rise rate threshold, and the like. Such parameters may be appropriately set on the basis of the empirical knowledge of a designer for the cryopump 10 or experiments or simulations by the designer, and may be stored in advance in the cryopump controller 100.

Additionally, the cryopump controller 100 may be configured to store information related to the regeneration or other control of the cryopump 10, such as the measured temperature of the temperature sensor 26, the measured pressure of the pressure sensor 28, the open and closed states of each valve and the result of the RoR test. The cryopump controller 100 may be configured to notify the user of such information visually or in other formats. The cryopump controller 100 may be configured to transmit such information to other devices or may transmit the information to remote devices via a network such as the Internet.

The internal configuration of the cryopump controller 100 is realized by elements and circuits including a CPU and memories of a computer as a hardware configuration and is realized by computer programs as a software configuration, but is appropriately shown in the drawings as functional blocks realized through the cooperation therebetween. It is clear for those skilled in the art that the functional blocks can be realized in various forms by the combination of hardware and software.

For example, the cryopump controller 100 can be mounted by the combination of a processor (hardware) such as a central processing unit (CPU) and a microcomputer and software programs executed by the processor (hardware). Such a hardware processor may be composed of a programmable logic device such as a field programmable gate array (FPGA) or may be a control circuit such as a programmable logic controller (PLC). The software programs may be computer programs for causing the cryopump controller 100 to execute the regeneration of the cryopump 10.

Figure 2:
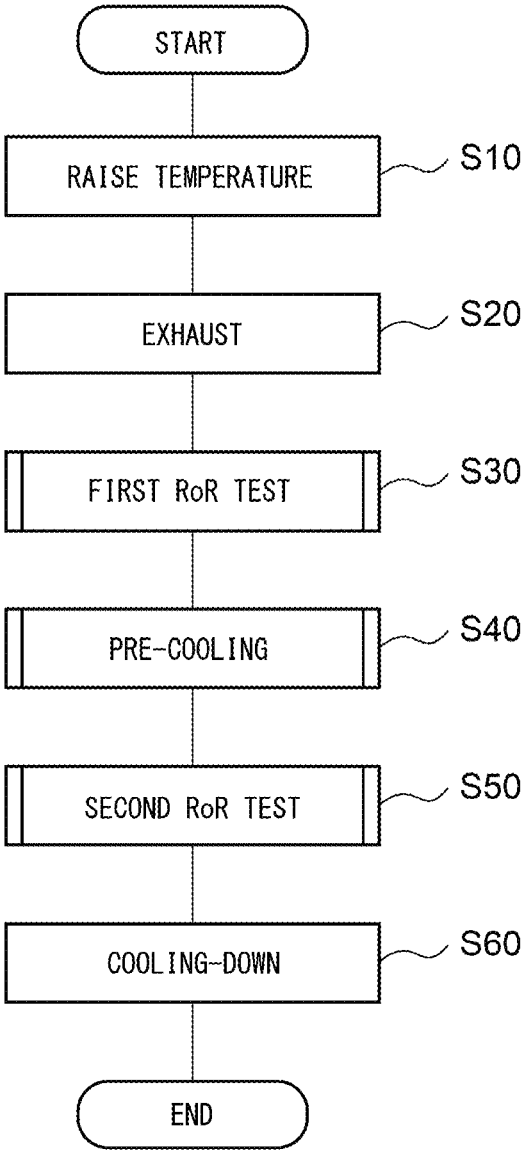
FIG. 2 is a flowchart showing a regeneration method of the cryopump according to the embodiment.

FIG. 2 is a flowchart showing the regeneration method of the cryopump 10 according to the embodiment. The regeneration sequence of the cryopump 10 includes a temperature raising process (S10), an exhausting process (S20), and a cooling-down process (S60). During the regeneration of the cryopump 10, the temperature sensor 26 periodically measures the temperature of the cryopanel 18, and the pressure sensor 28 periodically measures the internal pressure of the cryopump container 16.

In the temperature raising process (S10), the temperature of the cryopump 10 is raised from a cryogenic temperature to the room temperature or a regeneration temperature higher than the room temperature by the purge gas supplied to the cryopump container 16 through the purge valve 22 or other heating means (for example, about 290K to about 300K). As for the temperature rise of the cryopump 10, for example, a reverse temperature rise by the cryocooler 14 may be used, or in a case where an electric heater is installed in the cryopump 10, this electric heater may be used. In this way, the gas captured in the cryopanel 18 is vaporized again.

In the exhausting process (S20), the gas is exhausted from the cryopump container 16 to the outside through the vent valve 24 and the exhaust line 32 or through the rough valve 20 and the rough pump 30. In the exhausting process, so-called rough and purge may be performed. The rough and purge means exhausting, from the cryopump container 16, the gas (for example, the gas such as steam adsorbed on, for example, an adsorbent such as activated carbon on the cryopanel 18) remaining in the cryopump container 16 by alternately repeating the rough pumping of the cryopump container 16 through the rough valve 20 and the supply of the purge gas to the cryopump container 16 through purge valve 22.

In this embodiment, when the internal pressure of the cryopump container 16 decompressed to the first pressure region (for example, to a pressure value or pressure range selected from a range of 10 Pa to 100 Pa or a range of 20 Pa to 30 Pa) in order to check that the gas (mainly, moisture) to be exhausted has been sufficiently exhausted from the cryopump 10, the two-step RoR test is executed under different temperature and pressure conditions.

First, as the first RoR test (S30), when the temperature of the cryopanel 18 is in the first temperature zone and the internal pressure of the cryopump container 16 is in the first pressure region, the pressure rise rate of the cryopump container 16 is compared with the first pressure rise rate threshold. The first temperature zone may be, for example, higher than 0° C. and lower than the heat resistant temperature of the cryopump 10. The heat resistant temperature of the cryopump 10 may be selected from, for example, the range of 50° C. to 80° C. The first temperature zone may be, for example, the room temperature, or a temperature value or temperature range selected from a range of 15° C. to 25° C. The first pressure rise rate threshold may be, for example, a value of the pressure rise rate selected from a range of 1 Pa/min to 50 Pa/min or a range of 5 Pa/min to 20 Pa/min.

In a case where the first RoR test (S30) is passed, the cryopanel 18 is cooled from the first temperature zone to the second temperature zone lower than the first temperature zone by the cryocooler 14 as pre-cooling (S40). The second temperature zone may be, for example, a temperature value or a temperature range selected from a range of 50K or higher and 100K or lower. As a result of the pre-cooling, the residual gas (for example, steam) in the cryopump container 16 whose steam pressure is sufficiently low in the second temperature zone is condensed again on the cryopanel 18, and thereby the internal pressure of the cryopump container 16 is reduced from the first pressure region to the second pressure region lower than the first pressure region. The second pressure region may be, for example, a pressure value or pressure range selected from a range of 0.01 Pa to 1 Pa, and may be, for example, less than 0.1 Pa.

In the midst of the pre-cooling (S40), the rough valve 20 may be controlled such that the internal pressure of the cryopump container 16 is maintained in a predetermined pressure region while the temperature of the cryopanel 18 is lowered from the first temperature zone to the second temperature zone. The predetermined pressure region may be the same as the first pressure region in which the first RoR test is executed, for example, may be a pressure value or pressure range selected from a range of 10 Pa to 100 Pa or 20 Pa to 30 Pa.

Then, as the second RoR test (S50), when the temperature of the cryopanel 18 is in the second temperature zone and the internal pressure of the cryopump container 16 is in the second pressure region, the pressure rise rate of the cryopump container 16 is compared with the second pressure rise rate threshold. The second pressure rise rate threshold is smaller than the first pressure rise rate threshold. The second pressure rise rate threshold may be, for example, a value of the pressure rise rate selected from a range of 0.05 Pa/min to 0.5 Pa/min (for example, about 0.1 Pa/min).

In a case where the second RoR test (S50) is passed, the discharging process (S20) is terminated and the cooling-down process (S60) is started. The cryocooler 14 cools the cryopanel 18 from the second temperature zone to the third temperature zone lower than the second temperature zone. The third temperature zone is a cryogenic temperature that enables the vacuum pumping operation of the cryopump 10 and may be, for example, a temperature value or a temperature range selected from a range of 10K to 20K. In this way, the regeneration is completed, and the cryopump 10 can start the vacuum pumping operation again.

Figure 3:
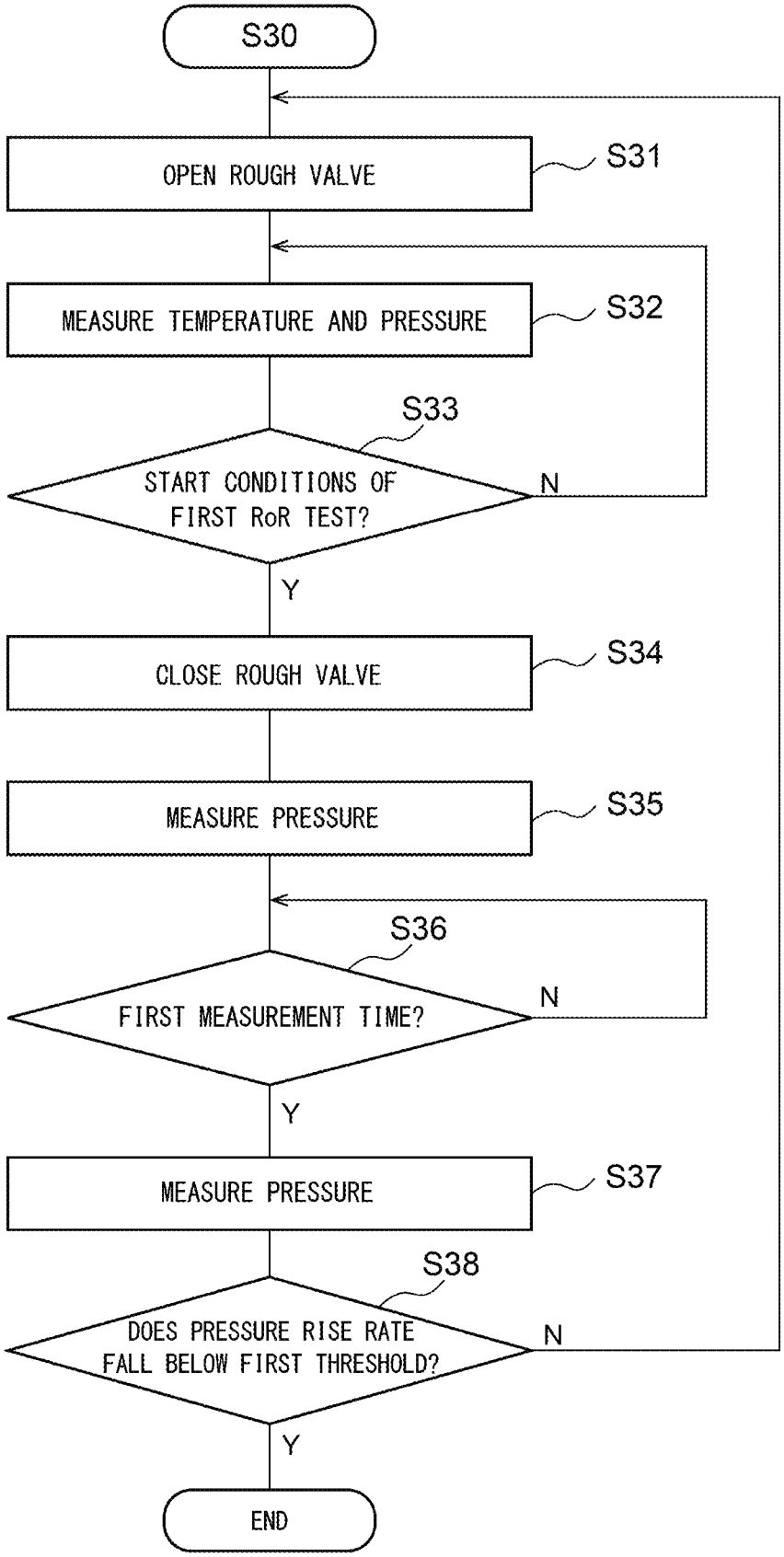
FIG. 3 is a flowchart showing a part of the regeneration method shown in FIG. 2 in more detail.
Figure 4:
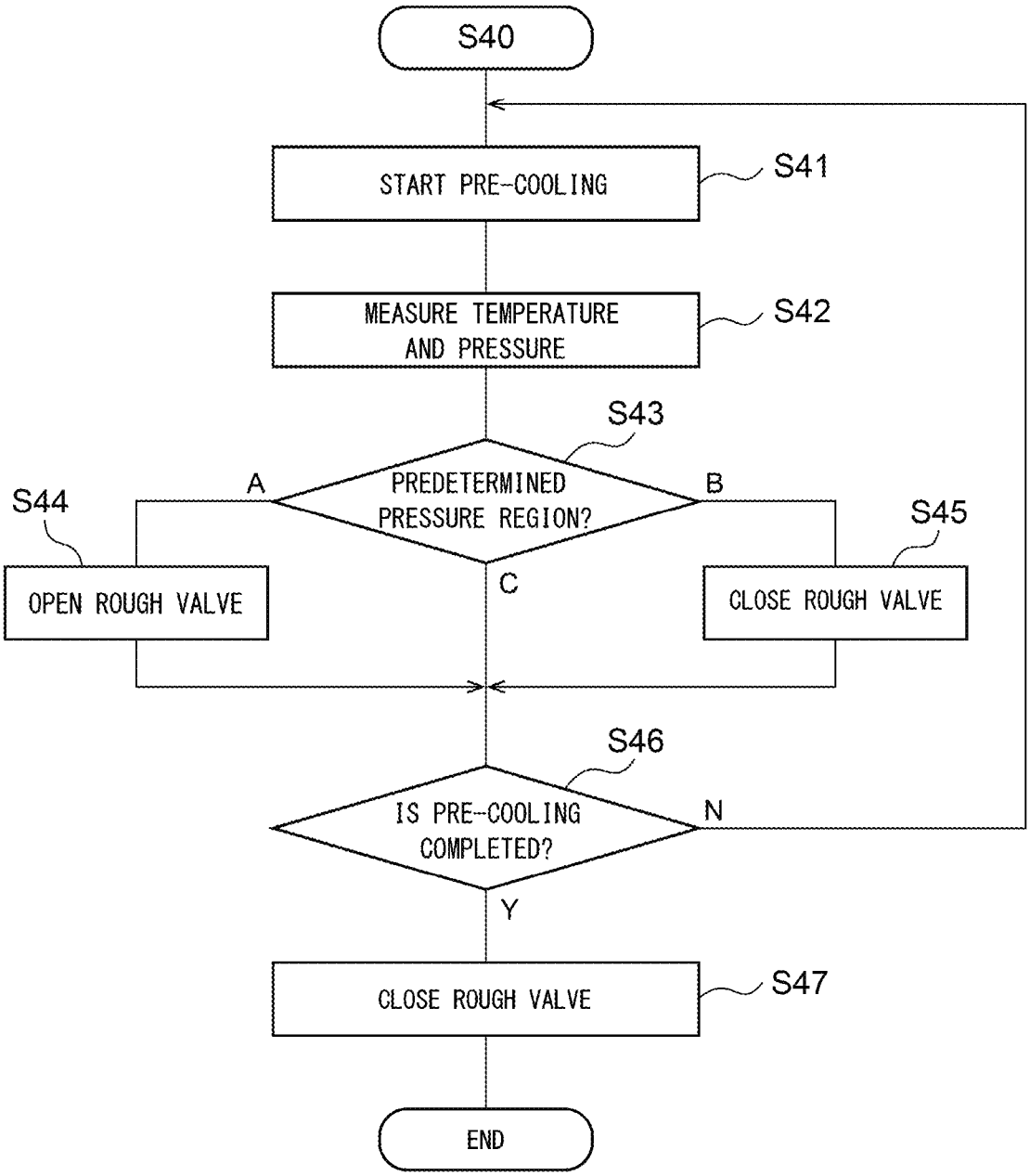
FIG. 4 is a flowchart showing a part of the regeneration method shown in FIG. 2 in more detail.
Figure 5:
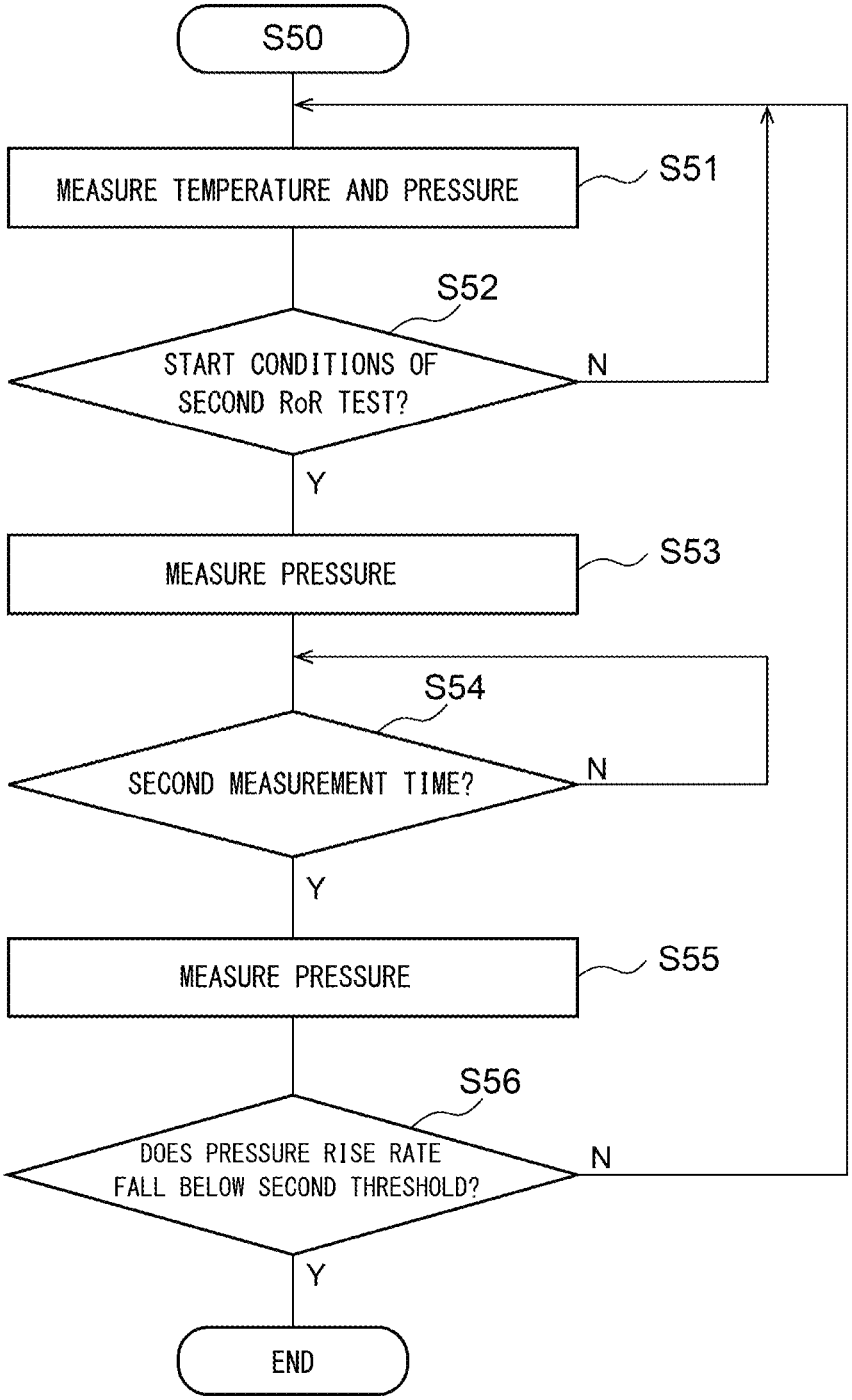
FIG. 5 is a flowchart showing a part of the regeneration method shown in FIG. 2 in more detail.

FIGS. 3 to 5 are flowcharts showing a part of the regeneration method shown in FIG. 2 in more detail, respectively. FIG. 3 shows the first RoR test (S30), FIG. 4 shows the pre-cooling (S40), and FIG. 5 shows the second RoR test (S50). Examples of the first RoR test (S30), the pre-cooling (S40), and the second RoR test (S50) will be described with reference to FIGS. 3 to 5.

As shown in FIG. 3, the rough valve 20 is opened as the preparation for executing the first RoR test (S31). When the rough valve 20 is opened by the valve controller 130, the cryopump container 16 is rough-pumped and decompressed by the rough pump 30. This rough pumping may be performed as part of the above-described rough and purge.

During the rough pumping, the temperature sensor 26 measures the temperature of the cryopanel 18, and the pressure sensor 28 measures the internal pressure of the cryopump container 16 (S32). A measured temperature signal of the temperature sensor 26 and a measured pressure signal of the pressure sensor 28 are given to the cryopump controller 100.

It is determined whether or not the start conditions of the first RoR test are satisfied (S33). The start conditions of the first RoR test are that the temperature of the cryopanel 18 is in the first temperature zone and the internal pressure of the cryopump container 16 is in the first pressure region. As described above, the first temperature zone is, for example, room temperature (for example, a temperature value or temperature range selected from a range of 15° C. to 25° C.), and the first pressure region is, for example, a pressure value or pressure range selected from a range of 20 Pa to 30 Pa.

Thus, the pressure rise rate comparator 110 determines whether or not the temperature of the cryopanel 18 is in the first temperature zone and the internal pressure of the cryopump container 16 is the first pressure region on the basis of the measured temperature signal of the temperature sensor 26 and the measured pressure signal of the pressure sensor 28. On the basis of the measured temperature signal and the measured pressure signal, the pressure rise rate comparator 110 compares the measured temperature of the cryopanel 18 with the first temperature zone and compares the measured internal pressure of the cryopump container 16 with the first pressure region. The pressure rise rate comparator 110 may determine that the start conditions of the first RoR test are satisfied in a case where the measured temperature is in the first temperature zone and the measured pressure is in the first pressure region. Alternatively, the pressure rise rate comparator 110 may determine that the start conditions of the first RoR test are satisfied in a case where the measured temperature is in the first temperature zone or a temperature higher than the first temperature zone and the measured pressure is in the first pressure region or a pressure lower than the first pressure region.

In a case where the start conditions of the first RoR test are not satisfied (N in S33), the temperature sensor 26 measures the temperature of the cryopanel 18 again, the pressure sensor 28 measures the internal pressure of the cryopump container 16 again (S32), and whether or not the start conditions of the first RoR test are satisfied is determined again (S33). In a case where the measured temperature of the cryopanel 18 is out of the first temperature zone (for example, lower than the first temperature zone), before the temperature is measured again), the cryopump controller 100 may control temperature raising means (for example, the purge valve 22, the cryocooler 14, and/or the electric heater) of the cryopump 10 and adjust the temperature of the cryopanel 18. In a case where the measured pressure of the cryopump container 16 is out of the first pressure region (for example, higher than the first pressure region), before the pressure is measured again, the valve controller 130 may close the rough valve 20 and open the purge valve 22, and then, may close the purge valve 22 and open the rough valve 20 again. After the purge gas is supplied to the cryopump container 16 in this way, the cryopump container 16 may be rough-pumped again.

In a case where the start conditions of the first RoR test are satisfied (Y in S33), the rough valve 20 is closed (S34). In this case, the valve controller 130 closes not only the rough valve 20 but also the purge valve 22 and the vent valve 24. Accordingly, the cryopump container 16 is isolated from the ambient environment. In this way, the first RoR test is started.

First, the internal pressure of the cryopump container 16 is measured by the pressure sensor 28 (S35). The pressure rise rate comparator 110 uses this measured pressure as a reference pressure for the first RoR test. The pressure rise rate comparator 110 determines whether or not a first measurement time has elapsed from the acquisition of the reference pressure (S36). The first measurement time may be, for example, several tens of seconds to several minutes (for example, about 30 seconds to 2 minutes, or for example, 1 minute). The pressure rise rate comparator 110 waits until the first measurement time elapses (N in S36). In a case where the first measurement time elapses (Y in S36), the internal pressure of the cryopump container 16 is measured again by the pressure sensor 28 (S37).

As the first RoR test, the pressure rise rate comparator 110 compares the pressure rise rate of the cryopump container 16 with the first pressure rise rate threshold (S38). In order to compare with the first pressure rise rate threshold, the pressure rise rate comparator 110 acquires the pressure rise rate from the pressure rise amount of the cryopump container 16 at the first measurement time. Specifically, the pressure rise rate comparator 110 subtracts the reference pressure (S35) from the measured pressure (S37) after the elapse of the first measurement time and acquires the pressure rise amount of the cryopump container 16 at the first measurement time. The pressure rise rate comparator 110 divides this pressure rise amount by the first measurement time, acquires the pressure rise rate of the cryopump container 16, and compares the acquired pressure rise rate with the first pressure rise rate threshold. The first pressure rise rate threshold is, for example, a value of the pressure rise rate selected from a range of 5 Pa/min to 20 Pa/min.

In a case where the first RoR test has failed, that is, in a case where the pressure rise rate of the cryopump container 16 exceeds the first pressure rise rate threshold (N in S38), the process (S30) shown in FIG. 3 is executed again. In this case, before the rough valve 20 is opened again in S31, the valve controller 130 may open the purge valve 22 once and supply the purge gas to the cryopump container 16. The cryopump controller 100 may output information, such as storing information indicating that the first RoR test has failed or notifying a user of this information. The cryopump controller 100 may count the number of times of the fail of the first RoR test, and in a case where the number of times reaches a predetermined number of times, the cryopump controller 100 may store or output this information or may stop the operation of the cryopump 10.

In a case where the first RoR test is passed, that is, in a case where the pressure rise rate of the cryopump container 16 falls below the first pressure rise rate threshold (Y in S38), the pre-cooling (S40) of the cryopump 10 shown in FIG. 4 is started.

As the pre-cooling of the cryopump 10 (S40), as shown in FIG. 4, the cooling operation of the cryocooler 14 is started by the cryocooler controller 120 (S41), and the cryopump 10 is cooled. While the cryopanel 18 is cooled from the first temperature zone to the second temperature zone, the temperature of the cryopanel 18 is measured by the temperature sensor 26, and the internal pressure of the cryopump container 16 is measured by the pressure sensor 28 (S42).

The rough valve 20 is controlled by the valve controller 130 such that the internal pressure of the cryopump container 16 is maintained in the predetermined pressure region while the temperature of the cryopanel 18 is lowered from the first temperature zone to the second temperature zone. The predetermined pressure region is set to, for example, a pressure range in which an upper limit value is 30 Pa and a lower limit value is 20 Pa.

Thus, the valve controller 130 compares the measured pressure of the cryopump container 16 with the predetermined pressure region on the basis of the measured pressure signal from the pressure sensor 28 (S43). In a case where the measured pressure exceeds the upper limit value of the predetermined pressure region (A in S43), the valve controller 130 opens the rough valve 20 (S44). In this way, the cryopump container 16 is decompressed such that the internal pressure of the cryopump container 16 falls below the upper limit value. In a case where the measured pressure falls below the lower limit value of the predetermined pressure region (B in S43), the valve controller 130 closes the rough valve 20 (S45). Additionally, in a case where the measured pressure is in the predetermined pressure region (between the upper limit value and the lower limit value) (C in S43), the valve controller 130 keeps the current open and closed state of the rough valve 20. In this way, the internal pressure of the cryopump container 16 is maintained in the predetermined pressure region.

Next, it is determined whether or not the pre-cooling is completed (S46). The cryocooler controller 120 determines whether or not the temperature of the cryopanel 18 is in the second temperature zone on the basis of the measured temperature signal of the temperature sensor 26. As described above, the second temperature zone is selected from, for example, a range of 50K or higher and 100K or lower, and may be, for example, a temperature range of 80K to 100K. In a case where the measured temperature of the cryopanel 18 is out of the second temperature zone (for example, higher than the second temperature zone) (N in S46), the process (S40) shown in FIG. 4 is executed again.

In a case where the measured temperature of the cryopanel 18 is in the second temperature zone (for example, is in the second temperature zone or falls below the second temperature zone) (Y in S46), the rough valve 20 (and other valves) is closed by the valve controller 130 (S47), and the second RoR test (S50) shown in FIG. 5 is started. In this case, the cryocooler controller 120 may control the cryocooler 14 such that the temperature of the cryopanel 18 is maintained in the second temperature zone during the second RoR test on the basis of the measured temperature signal from the temperature sensor 26.

As shown in FIG. 5, as the preparation for executing the second RoR test, the temperature sensor 26 measures the temperature of the cryopanel 18, the pressure sensor 28 measures the internal pressure of the cryopump container 16 (S51), and whether or not the start conditions of the second RoR test are satisfied is determined (S52). The start conditions of the second RoR test are that the temperature of the cryopanel 18 is in the second temperature zone and the internal pressure of the cryopump container 16 is in the second pressure region. As described above, the second pressure region is set to be lower than the first pressure region, for example, less than 0.1 Pa.

Thus, the pressure rise rate comparator 110 determines whether or not the temperature of the cryopanel 18 is in the second temperature zone and the internal pressure of the cryopump container 16 is the second pressure region on the basis of the measured temperature signal of the temperature sensor 26 and the measured pressure signal of the pressure sensor 28. On the basis of the measured temperature signal and the measured pressure signal, the pressure rise rate comparator 110 compares the measured temperature of the cryopanel 18 with the second temperature zone and compares the measured internal pressure of the cryopump container 16 with the second pressure region. The pressure rise rate comparator 110 determines that the start conditions of the second RoR test are satisfied in a case where the measured temperature is in the second temperature zone and the measured pressure is in the second pressure region.

In a case where the start conditions of the second RoR test are not satisfied (N in S52), the temperature sensor 26 measures the temperature of the cryopanel 18 again, the pressure sensor 28 measures the internal pressure of the cryopump container 16 again (S51), and whether or not the start conditions of the second RoR test are satisfied is determined again (S52). In a case where the start conditions of the second RoR test are satisfied (Y in S52), the second RoR test is started.

First, the internal pressure of the cryopump container 16 is measured by the pressure sensor 28 (S53). The pressure rise rate comparator 110 uses this measured pressure as a reference pressure for the second RoR test. The pressure rise rate comparator 110 determines whether or not a second measurement time has elapsed from the acquisition of the reference pressure (S54). The second measurement time is longer than the first measurement time and may be, for example, several minutes to several tens of minutes (for example, about 5 to 20 minutes, or for example, 10 minutes). The pressure rise rate comparator 110 waits until the second measurement time elapses (N in S54). When the second measurement time has elapsed (Y in S54), the internal pressure of the cryopump container 16 is measured again by the pressure sensor 28 (S55).

As the second RoR test, the pressure rise rate comparator 110 compares the pressure rise rate of the cryopump container 16 with the second pressure rise rate threshold (S56). In order to compare with the second pressure rise rate threshold, the pressure rise rate comparator 110 acquires the pressure rise rate from the pressure rise amount of the cryopump container 16 at the second measurement time. Similar to the first RoR test, the pressure rise rate used in the second RoR test is obtained from the measured pressure (S55) after the elapse of the second measurement time, the reference pressure (S53), and the second measurement time. The second pressure rise rate threshold is, for example, a value of the pressure rise rate selected from a range of 0.05 Pa/min to 0.5 Pa/min, for example, 0.1 Pa/min (that is, a pressure rise amount for 1 Pa in 10 minutes).

In a case where the second RoR test is passed, that is, in a case where the pressure rise rate of the cryopump container 16 falls below the second pressure rise rate threshold (Y in S56), the cooling-down of the cryopump 10 (S60 in FIG. 2) is started. The cryocooler controller 120 controls the cryocooler 14 so as to lower the temperature of the cryopanel 18 from the second temperature zone to the third temperature zone lower than the second temperature zone.

In a case where the second RoR test has failed, that is, in a case where the pressure rise rate of the cryopump container 16 exceeds the second pressure rise rate threshold (N in S56), the process (S50) shown in FIG. 5 may be executed again. Alternatively, even in a case where the second RoR test has failed the cooling-down of the cryopump 10 (S60 in FIG. 2) may be started similar to the case where the test is passed. In this case, the cryopump controller 100 may output information, such as storing information indicating that the second RoR test has failed or notifying a user of this information. The cryopump controller 100 may count the number of times of the fail of the second RoR test, and in a case where the number of times reaches a predetermined number of times, the cryopump controller 100 may store or output this information or may stop the operation of the cryopump 10.

In addition, the cryopump controller 100 may monitor the pressure rise rate (or pressure rise amount) in the second RoR test. The cryopump controller 100 may execute a leakage check of the cryopump container 16 on the basis of the monitoring result of the pressure rise rate in the second RoR test. For example, the cryopump controller 100 may compare the pressure rise rate in the second RoR test in the current regeneration with the pressure rise rate in the second RoR test in the previous regeneration (for example, the previous generation, the generation before last, or the regeneration before the time before last), and may detect leakage of the cryopump container 16 in a case where the amount of change in the pressure rise rate exceeds a threshold. In this way, during the long-term operation of the cryopump 10, the pressure rise rate in the second RoR test may be periodically monitored.

Meanwhile, in the existing cryopumps, the RoR test of only one step is typically performed, and in a case where the test is passed, the cooling-down of the cryopump is started and the regeneration is completed. In the one-step RoR test, the cryopump is first rough-pumped to, for example, 10 Pa or the reference pressure lower than the 10 Pa, and the RoR test is performed at this reference pressure. The pressure rise rate threshold for the RoR test is, for example, 5 Pa/min.

The main purpose of the RoR test is to check that the gas remaining (for example, a gas such as steam adsorbed by, for example, an adsorbent, such as activated carbon on the cryopanel 18) in the cryopump is sufficiently exhausted from the cryopump. Another purpose is to check leakage in each valve of the cryopump, including rough valves. A further purpose includes setting the reference pressure of the RoR test to a low pressure of less than 10 Pa as described above to enhance the vacuum insulation effect of the cryopump container, thereby suppressing input of heat from the surroundings into the cryopump during the cooling-down, shortening the cooling-down time, and suppressing the cooling and dew condensation of the cryopump container itself.

In fact, the existing cryopumps are designed to realize the plurality of purposes in the one-step RoR test. Such a design is considered to be advantageous because the design also leads to a shortening of the regeneration time. However, according to the study of the present inventor, particularly in a case where the cryopump is loaded with a large amount of adsorbent, the degree of the adsorbent acting as a gas release source during the rough pumping increases. Therefore, the time required for the rough pumping tends to be long. Particularly in a case where the cryopump is rough-pumped to the reference pressure that is a low pressure of, for example, less than 10 Pa, the gas release from the adsorbent and the gas exhaust resulting from the rough pumping may antagonize each other, and the time required for the rough pumping may be significantly increased. As an example, there may be a case where the rough pumping of 20 Pa to 10 Pa takes several tens of minutes or more. Alternatively, even in a case where the exhaust capacity of the rough pump used with the cryopump is low, the time required for the rough pumping may be increased. The longer the rough pumping time, the longer the regeneration time, which is not desirable.

In contrast, the cryopump 10 according to the embodiment is configured to execute the first RoR test under a high temperature and low vacuum and execute the second RoR test under a low temperature and high vacuum as compared to the first RoR test. By dividing the existing RoR test of only one step into two-step RoR tests with different conditions, it is possible not only to optimize the conditions of each RoR test for individual purposes but also to shorten the regeneration time.

More specifically, in the cryopump 10 according to the embodiment, the first pressure region, which is the reference pressure of the first RoR test, is higher than the second pressure region, which is the reference pressure of the second RoR test. For that reason, the rough pumping to the first pressure region for starting the first RoR test can be completed in a shorter time than in a case where rough pumping to a lower pressure is performed. This also leads to a shortening of the regeneration time. In addition, such a first RoR test can also be used to check whether or not a serious leakage occurs in the cryopump container 16. It is considered that such a serious leakage is usually caused by leakage through each valve of the cryopump 10 such as the rough valve 20.

The first pressure region is preferably selected from a range of 10 Pa to 100 Pa and is more preferably selected from a range of 20 Pa to 30 Pa. By doing so, the rough pumping to the first pressure region for starting the first RoR test can be completed in a considerably short time as compared to a case where the reference pressure is less than 10 Pa as in the RoR test with the existing cryopumps.

Additionally, in the cryopump 10 according to the embodiment, the second temperature zone in which the second RoR test is executed is lower than the second temperature zone in which the first RoR test is executed. In executing the second RoR test, the internal pressure of the cryopump container 16 is decompressed to the second pressure region by such cooling from the first temperature zone to the second temperature zone, not by the rough pumping. This also helps to shorten the rough pumping time and thus the regeneration time.

Moreover, the second pressure rise rate threshold of the second RoR test is smaller than the first pressure rise rate threshold of the first RoR test. Accordingly, an accurate valve leakage check can be realized through the second RoR test. For example, it is possible to detect a slight valve leakage due to long-term deterioration over time due to the progress of valve corrosion or signs of such leakage. In this way, by monitoring the minute leakage of the valve, planned maintenance such as repair or replacement of the valve can be performed before such a serious leakage occurs in the valve, and it is possible to take measures to minimize the influence on the operation of the cryopump 10 and a vacuum process device loaded with the cryopump.

The second temperature zone is selected from a range of 50K or higher and 100K or lower. By doing so, the residual gas (for example, steam) in the cryopump container 16 whose steam pressure is sufficiently low in the second temperature zone can be condensed again on the cryopanel 18, and thereby the internal pressure of the cryopump container 16 can be decompressed to the second pressure region. In this way, the second pressure region can be selected from a range of 0.01 Pa to 1 Pa, and the second pressure rise rate threshold can be selected from a range of 0.05 Pa/min to 0.5 Pa/min. By setting the second pressure region to a low pressure that is difficult to realize in the typical rough pump 30 and making the second pressure rise rate threshold one digit or more smaller than the first pressure rise rate threshold, it is possible to accurately check a minute leakage in the valve through the second RoR test. In addition, in a case where the temperature of the second temperature zone is lower than 50K, a gas, which may be used for leakage check, such as nitrogen, can also be condensed on the cryopanel 18. Therefore, this gas is not suitable for leakage check.

Additionally, in this embodiment, the rough valve 20 is controlled such that the internal pressure of the cryopump container 16 is maintained in the predetermined pressure region (for example, in a range of 20 Pa to 30 Pa) during the pre-cooling from the first temperature zone to the second temperature zone. By doing so, an increase in the internal pressure of the cryopump due to the desorption of gas (for example, steam) from the adsorbent such as activated carbon during the pre-cooling can be suppressed by using the rough pumping.

In addition, the internal pressure of the cryopump is maintained in the predetermined pressure region depending on the design and operation of the cryopump 10. Accordingly, the cooling time of the cryopump 10 can be shortened than that in a case where the internal pressure of the cryopump is excessively low (for example, less than 10 Pa). For example, in a case where the cryocooler 14 is temperature-controlled such that the cryopanel 18 maintains a target cryogenic temperature, the internal pressure of the cryopump takes a certain degree of magnitude as in the above predetermined pressure region. Accordingly, the input of heat from the surroundings to the cryopump 10 has the effect of increasing the cooling capacity of the cryocooler 14, and thereby, the cooling time of the cryopump 10 can be shortened.

Additionally, in the second RoR test, the pressure rise rate is acquired from the pressure rise amount of the cryopump container 16 in the second measurement time longer than the first measurement time. By lengthening the second measurement time, even when the second pressure rise rate threshold is small, the second RoR test can be determined on the basis of a larger pressure rise amount. It is possible to accurately detect a minute valve leakage.

The present invention has been described above on the basis of the embodiment. It should be understood by those skilled in the art that the present invention is not limited to the above embodiment, that various design changes are possible and various modification examples are possible, and that such modification examples are also within the scope of the present invention.

It should be understood that the invention is not limited to the above-described embodiment, but may be modified into various forms on the basis of the spirit of the invention. Additionally, the modifications are included in the scope of the invention.

What is claimed is:

1. A cryopump comprising:

a cryocooler;

a cryopanel cooled by the cryocooler;

a cryopump container supporting the cryocooler and accommodating the cryopanel;

a temperature sensor configured to measure a temperature of the cryopanel and output a measured temperature signal indicating the temperature;

a pressure sensor configured to measure an internal pressure of the cryopump container and output a measured pressure signal indicating the internal pressure;

a cryopump controller including a pressure rise rate comparator configured to compare a pressure rise rate of the cryopump container with a first pressure rise rate threshold when the temperature of the cryopanel is in a first temperature zone and the internal pressure of the cryopump container is in a first pressure region, on the basis of the measured temperature signal and the measured pressure signal; and a cryocooler controller configured to control the cryocooler so as to lower the temperature of the cryopanel from the first temperature zone to a second temperature zone lower than the first temperature zone when the pressure rise rate of the cryopump container falls below the first pressure rise rate threshold, wherein the pressure rise rate comparator is further configured to compare the pressure rise rate of the cryopump container with a second pressure rise rate threshold when the temperature of the cryopanel is in the second temperature zone and the internal pressure of the cryopump container is in a second pressure region, on the basis of the measured temperature signal and the measured pressure signal, and wherein the second pressure region is lower than the first pressure region, and the second pressure rise rate threshold is smaller than the first pressure rise rate threshold.

2. The cryopump according to claim 1, wherein the first pressure region is selected from a range of 10 Pa to 100 Pa, the first pressure rise rate threshold is selected from a range of 1 Pa/min to 50 Pa/min, the second pressure region is selected from a range of 0.01 Pa to 1 Pa, and the second pressure rise rate threshold is selected from a range of 0.05 Pa/min to 0.5 Pa/min.

3. The cryopump according to claim 1, wherein the first pressure region is selected from a range of 20 Pa to 30 Pa, and the first pressure rise rate threshold is selected from a range of 5 Pa/min to 20 Pa/min.

4. The cryopump according to claim 1, wherein the second temperature zone is selected from a range of 50K to 100K.

5. The cryopump according to claim 1, wherein the first temperature zone is higher than 0° C.

6. The cryopump according to claim 1, further comprising:

a rough valve attached to the cryopump container and connecting the cryopump container to a rough pump; and a valve controller configured to control the rough valve such that the internal pressure of the cryopump container is maintained in a predetermined pressure region on the basis of the measured pressure signal while the temperature of the cryopanel is lowered from the first temperature zone to the second temperature zone.

7. The cryopump according to claim 6, wherein the predetermined pressure region is selected from a range of 10 Pa to 100 Pa.

8. The cryopump according to claim 6, wherein the predetermined pressure region is selected from a range of 20 Pa to 30 Pa.

9. The cryopump according to claim 1, wherein the cryocooler controller is further configured to control the cryocooler so as to lower the temperature of the cryopanel from the second temperature zone to a third temperature zone lower than the second temperature zone when the pressure rise rate of the cryopump container falls below the second pressure rise rate threshold.

10. The cryopump according to claim 1, wherein the pressure rise rate comparator is configured to:

determine the pressure rise rate from a pressure rise amount of the cryopump container during a first measurement time to compare the pressure rise rate with the first pressure rise rate threshold, and determine the pressure rise rate from a pressure rise amount of the cryopump container during a second measurement time longer than the first measurement time to compare the pressure rise rate with the second pressure rise rate threshold.

11. A regeneration method of a cryopump, the method comprising:

measuring a temperature of a cryopanel;

measuring an internal pressure of a cryopump container;

comparing a pressure rise rate of the cryopump container with a first pressure rise rate threshold when the temperature of the cryopanel is in a first temperature zone and the internal pressure of the cryopump container is in a first pressure region;

cooling the cryopanel from the first temperature zone to a second temperature zone lower than the first temperature zone when the pressure rise rate of the cryopump container falls below the first pressure rise rate threshold; and comparing the pressure rise rate of the cryopump container with a second pressure rise rate threshold when the temperature of the cryopanel is in the second temperature zone and the internal pressure of the cryopump container is in a second pressure region, wherein the second pressure region is lower than the first pressure region, and the second pressure rise rate threshold is smaller than the first pressure rise rate threshold.

* * * * *